United States Patent [19]

Smith, Jr.

[11] 4,070,807

[45] Jan. 31, 1978

[54] AERIAL LIFT

[76] Inventor: Raymond E. Smith, Jr., 385 E. Greenwood, Lake Forest, Ill. 60045

[21] Appl. No.: 758,810

[22] Filed: Jan. 12, 1977

[51] Int. Cl.[2] ..... E04G 1/22

[52] U.S. Cl. ..... 52/109; 52/111; 52/119; 182/2; 182/63; 182/127; 182/141

[58] Field of Search ..... 182/63, 141, 2, 127; 52/111, 109, 119

[56] References Cited

U.S. PATENT DOCUMENTS

| | | | |
|---|---|---|---|
| Re. 27,914 | 2/1974 | King | 52/109 X |
| 2,501,001 | 3/1950 | Neely | 182/141 X |
| 2,530,127 | 11/1950 | Wallace | 52/119 X |
| 3,292,320 | 12/1966 | LaHarty | 52/119 |
| 3,796,282 | 3/1974 | Denier et al. | 52/109 X |

*Primary Examiner*—Alfred C. Perham

[57] ABSTRACT

An aerial lift including a pivotable boom with a pivot end that moves horizontally as the load end of the boom is raised and lowered, allowing the load end to move along a substantially vertical line. The boom is mounted on a vertically adjustable, substantially horizontal mounting table which cooperates with the boom to provide a lift with a greater reaching range.

10 Claims, 5 Drawing Figures

AERIAL LIFT

BACKGROUND OF THE INVENTION

This invention relates generally to aerial lifts and more particularly to an aerial lift which has a horizontally movable pivot point.

In building construction and maintenance, mining, storage/retrieval operations and many other fields, it is often necessary to provide aerial lifts for moving equipment and/or personnel. These lifts have generally been of two types; i.e., cranes and adjustable scaffolds. Conventional cranes are capable of lifting very large loads to relatively great heights. These cranes are usually vehicular to facilitate movement to the job site. When actual lifting is performed, however, the base of the crane, or the vehicle on which it is mounted, is ordinarily fixed in position by stabilizing pads. Since most cranes consist essentially of pivotable booms, this results in the pivot point being fixed. Thus, unless the boom is extensible, as the position of the boom is varied, the load end of the boom moves in an arc. If a load is suspended from the boom, this action will cause the load to swing toward the boom pivot end and, more importantly, toward the boom operator, thus increasing the safety hazards inherent in such operations. If the crane is being utilized to elevate workmen and/or equipment along a vertical plane, the load end necessarily moves increasingly further from said plane as the boom angle increases.

These disadvantages are often overcome by providing extensible, ordinarily telescoping, boom sections. These boom sections are ordinarily extended by power cylinders which extend to force the telescoping boom section outward. Thus, as the boom angle is increased, the power cylinder is extended by the operator thus increasing the length of the boom. This insures that the boom load end moves in a substantially vertical line. This extensible power cylinder dramatically increases the cost of such units. Also, to insure proper, safe operation, a highly skilled operator is required. The operator must pay close attention to retain the load in the original vertical plane. Even with a highly skilled, attentive operator this is often a very difficult procedure since the operator's line of sight is often inadequate to provide accurate adjustments. Due to the line-of-sight problem a second operator is often placed in closer proximity to the load end. This not only increases the cost of operating the crane, but also increases safety hazards since the possibility of misunderstanding between operators is ever present. While boom mechanism may be automated to retain the load in the same vertical plane, such automation systems are quite expensive.

Adjustable scaffolds are often utilized to move loads along a vertical plane. Scissors-type scaffolds, such as that described in my co-pending application, Ser. No. 738,599 filed Nov. 3, 1976, have been found to be advantageous. However, since such apparatuses do not provide a capability of lateral movement, they are limited in their scope of operation. If a simple, nonextensible crane were mounted on an adjustable scaffold, the reaching coverage of the apparatus is still limited, as discussed further hereinbelow and illustrated in the drawings.

Accordingly, one object of the present invention is the provision of a crane which need not have an extensible power cylinder for lengthening the boom but which can move a load in a substantially vertical plane. Another object is provision of a crane which can be easily automated. Yet another object is provision of an aerial lift which is simpler than present lifts but which has greater versatility and lifting range. These and other objects, features, and advantages of the present invention will be apparent from the following description, appended claims, and annexed drawings.

SUMMARY OF THE INVENTION

According to this invention there is provided an aerial lift having a boom whose pivot end moves in a horizontal direction as its load end is raised and lowered, to provide a crane which can move a load along a substantially vertical line without the necessity of the boom being extensible. A pivotable boom having a load end and a pivot end is mounted to a mounting table so that the boom pivot end is horizontally movable but vertically fixed. A support arm extends between the mounting table and a median point of the boom, and is pivotally mounted to each so that as the boom load end is adjusted upwardly and downwardly, the boom pivot end moves horizontally toward and away from said support arm. Finally, drive means for raising and lowering the boom is provided.

The novel features which are believed to be characteristic of the invention are set forth in the appended claims. It is believed the invention will be best understood by reference to the following description taken in connection with the accompanying drawings.

DETAILED DESCRIPTION OF THE PREFERRED EMBODIMENTS

Figure 1:
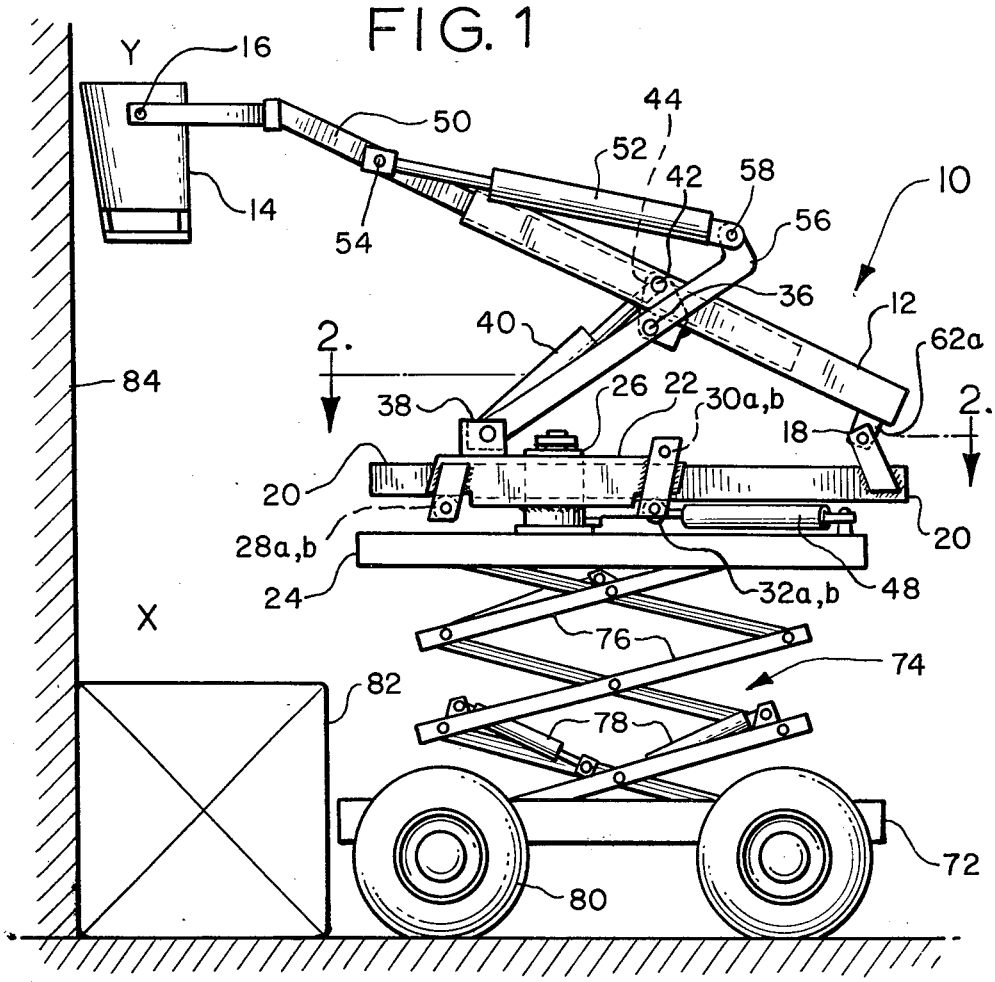
FIG. 1 is an elevation view of the invention in an intermediate position.

In that form of the invention depicted in the drawings, the aerial lift is indicated generally at 10. A pivotable boom 12 is shown to support a basket 14 which may be designed to carry a load. This load may include workmen but may alternatively or additionally include machinery of any conceivable type. In the depicted embodiment the basket 14 is allowed to rotate on pins 16 to maintain its upright position. The load end of the boom may include conventional lifting forks and automated or manual leveling mechanisms of conventional design to maintain the forks parallel to the ground. If the load is designed to be suspended from the boom, of course, no such leveling mechanism is required.

Figure 3:
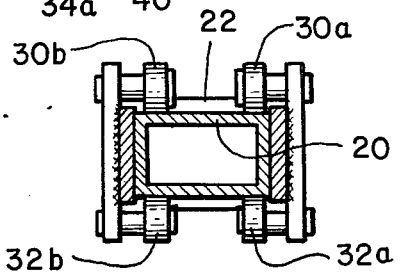
FIG. 3 is a sectional view taken along line 3—3 of FIG. 2.

The pivot end of the boom 12 is pivotally mounted at joint 18 to a sliding beam 20 which is slidably mounted in a channel which may alternatively be described either as being mounted to a mounting table 24, or as being a part of said mounting table. The channel 22 is rotatably mounted to the mounting table, or the remainder of the table, on a substantially vertical cylinder 26, to be described in more detail hereinbelow. The function of the channel 22 is to prevent axial displacement of the beam 20 with respect to the mounting table 24. Ordinarily both the beam 20 and the table 24 will be substantially horizontal as depicted, but this is not necessary for the proper operation of the apparatus. Rollers 28*a* and *b*, 30*a* and *b*, and 32*a* and *b* are provided as depicted in FIG. 3 to insure that the beam 20 is slidable within the channel 22. Since a downward loading of the boom load end will tend to force clockwise axial displacement of the beam 20 with respect to cylinder 26, rollers 28*a* and *b*, and 32*a* and *b* will ordinarily carry most of the load.

The boom 12 is also pivotably mounted to support arms 34 a and b at joint 36. These support arms 34a and b in turn are pivotally mounted to the channel 22 at joint 38. Thus, as the boom 12 is raised and lowered, the boom, beam, and support arm structure will pivot on joints 18, 36, and 38 to cause the beam to reciprocate with respect to the channel 22 and the mounting table 24.

Drive means for raising and lowering the boom 12 ordinarily comprises a hydraulic pivot cylinder 40 having one end pivotally mounted to the channel at a point no closer to the boom pivot end than the support arm joint 38, and the other end pivotally mounted to the boom 12 at a point remote from the support arm boom joint 36. The term "remote from" means only that the joints may not be coaxial. As depicted in the Figures, this pivot cylinder joint 42 is mounted to the boom 12 via plate 44 which is rigidly secured to the boom and which lies closer to the boom load end than does support arm joint 36. Also as depicted in the Figures, the other end of the pivot cylinder 40 is pivotally connected to the channel 22 at joint 38, coaxial with the point at which the support arm is mounted to the channel. This joint 38 will be further described hereinbelow.

While the above-described means of driving the lift is the preferred design, other means (not depicted) may alternately be utilized. For example, sliding beam 20 and rollers 18*a* and *b*, 30*a* and *b*, and 32*a* and *b* may act as a rack and pinion so that rotation of the rollers in either direction will change the lateral position of the beam 20, thus causing a change in the vertical position of the beam load end.

Figure 2:
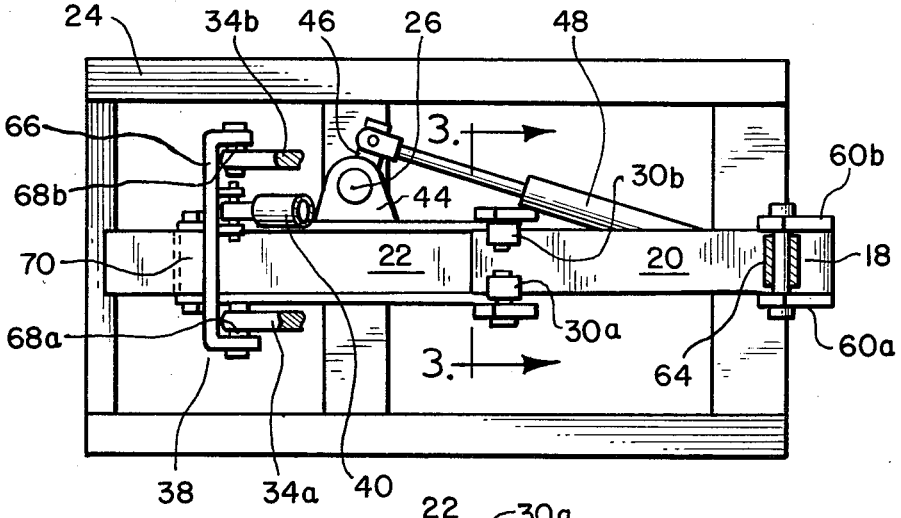
FIG. 2 is a sectional view taken along line 2—2 of FIG. 1.

As stated hereinabove, the channel 22 is rotatable with respect to the mounting table 24. This feature obviously increases the versatility of the lift to a substantial degree. The channel is rotatable on the vertical cylinder 26 which, as depicted in FIG. 2, is offset from the channel 22 and the remainder of the boom apparatus. The channel 22 is mounted on the vertical cylinder 26 by the member 44 which extends from the channel 22 and surrounds the vertical cylinder 26. Extending from member 44 is a leg 46 to which is pivotally mounted the rotational drive means, here a conventional hydraulic cylinder 48. The opposite end of this cylinder 48 is pivotally mounted to the mounting table 24.

One of the advantages of the present invention is that it allows a load to be elevated along a path which is much closer to a vertical line than do conventional booms which, when inextensible, swing the load in an arc. To provide a crane which can elevate a load along a line which is even closer to vertical, a telescoping section 50 can be added to the apparatus along with a telescoping cylinder 52. As shown one end of the telescoping cylinder 52 is pivotally attached to the telescoping section 50 at joint 54 while the other end is pivotally connected to a support arm extension 56 at joint 58. The telescoping cylinder itself need not be extensible, i.e., it may be rigid. As the boom is adjusted to various levels of inclination, the movement of the support arm extension causes the telescoping cylinder to automatically extend and retract the telescoping section of the boom. As shown in the Figures, however, the telescoping cylinder 52 ordinarily is a conventional extensible hydraulic cylinder. This provides a crane with even greater versatility.

As indicated in the Figures, the slidable beam 20 is ordinarily of rectangular configuration. The pivotable boom 12 and its telescoping section 50 are preferably also rectangular in cross-section. Thus, the rollers 18*a* and *b*, 30*a* and *b*, and 32*a* and *b* are mounted on opposite sides of the slidable beam 20. Similarly, joints 18 and 36 extend across the entire cross section of the boom. Beam legs 60*a* and 60*b* extend from each side of the end portion of the beam to meet legs 62*a* and 62*b* (not visible) at pivot joint 18. A suitable bearing 64 is provided.

As shown in FIG. 2 the support arms 34*a* and *b* extend between joints 36 and 38, one on each side of the boom 12. The support arm extension 56 is ordinarily an extension of one of these arms since the telescoping cylinder 52 extends from joint 58 to only one side of the telescoping section 50 at joint 58.

As mentioned hereinabove and shown in FIG. 2, the points at which the support arms 34 and the pivot cylinder 40 are mounted to the channel 22 are preferably coaxial at joint 38. A joint plate 66 is fixed to the top of the channel and extends across the entire cross-section of the slidable beam 20. This joint 38 is actually comprised of three separate joints, with the support arms 34*a* and *b* pivotable on pins 68*a* and *b*, respectively. The pivot cylinder pivots on pin 70.

The mounting table 24 to which the above-described apparatus is mounted is preferably vertically adjustable above a base 72. The means for raising and lowering the table 24 ordinarily is of scissors design, such as that described in my copending application Ser. No. 738,599, filed Nov. 3, 1976. This scissors mechanism shown generally at 74 includes scissors arms 76 and power cylinders 78. The base 72 is preferably provided with wheels 80 to insure mobility. Brakes (not shown) would also be desirable.

Figure 4:
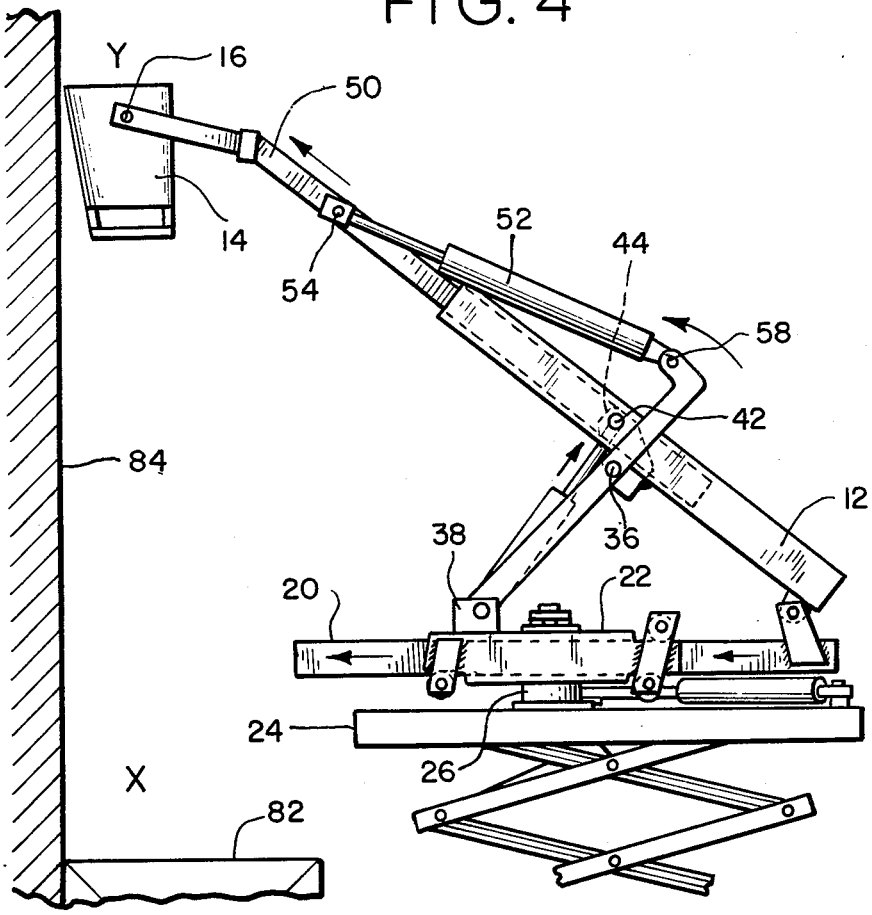
FIG. 4 is an elevation view of the invention in the fully elevated position.
Figure 5:
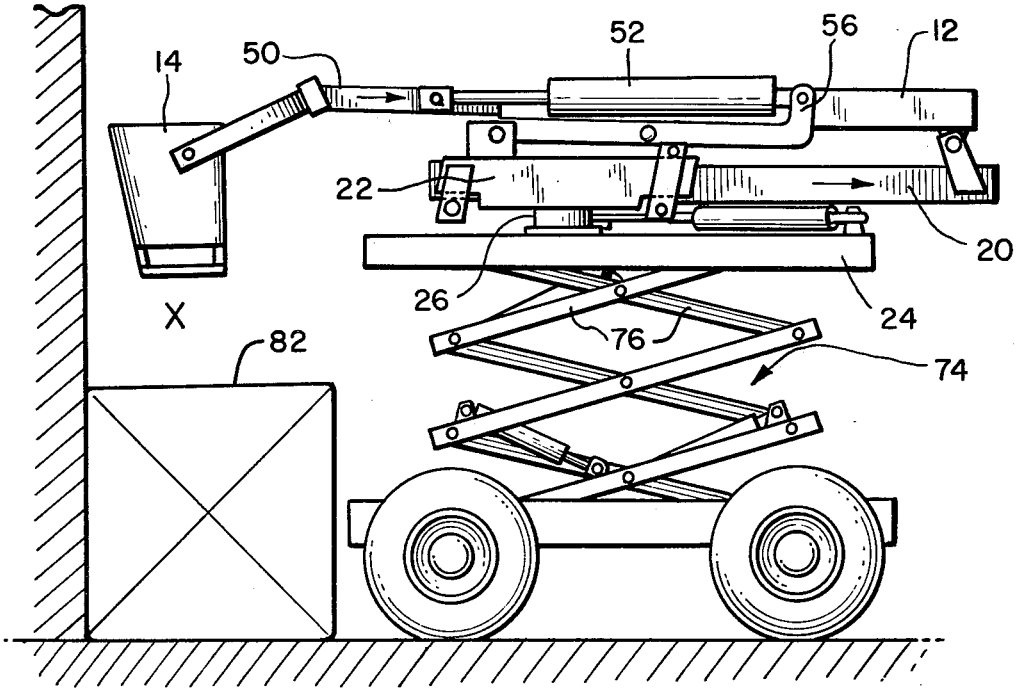
FIG. 5 is an elevation view of the invention in the fully lowered position.

In operation the above-described scissors mechanism cooperates with the pivotable boom apparatus to provide an aerial lift with greater reaching range. FIGS. 4 and 5 show the boom in lowered and raised positions, respectively, and FIG. 1 shows it in an intermediate position. A box 82 is included in these Figures to show that the aerial lift provides a reaching capability to all portions of the wall 84 with which the box 82 abuts. If the boom apparatus alone was mounted adjacent the wheels 80, the area indicated generally at X would be unreachable. Assuming the box 82 was substantially lower and the scissors mechanism 74 was fully collapsed, a conventional non-extensible boom would be unable to reach both area X and the area indicated at Y since the boom load end would necessarily move in an arc.

With the boom in the fully lowered position of FIG. 5 the pivot cylinder 40 is fully retracted and the slidable beam 20 is fully extended from the channel 22. The basket 14 is in its lowest position, nearly abutting the wall 84. To elevate the boom 12 the operator starts to extend the pivot cylinder 40, resulting in a rotational movement between joints 42 and 36. This causes joint 36 to swing upward and to the left, and the beam 20 to retract into the channel 22. The movement of the support arm extension 56 toward the boom load end causes the telescoping cylinder 52 to extend the telescoping section 50 of the boom 12, thus causing the bascket 14 to elevate and remain in close proximity to the wall 84. To reach the position shown in FIG. 4, the pivot cylinder is fully extended, causing the beam 20 to fully retract through the channel 22, and causing joint 36 to swing to its uppermost position. At the same time telescoping section 50 has become fully fixed extended. To lower the apparatus, the pivot cylinder 40 is retracted and the process is repeated. If lateral movement of the basket is desired, the boom telescoping section 50 can be further extended or retracted by activating the telescoping cylinder 52. For axial translation the rotation drive cylinder 48 is utilized. To rotate the boom apparatus in a clockwise direction with reference to FIG. 3, the rotation drive cylinder 48 is retracted and for counter-clockwise rotation the cylinder is extended.

Of course, it should be understood that various changes and modifications to the preferred embodiments described therein will be apparent to those skilled in the art. Such changes and modifications can be made without departing from the spirit and scope of the present invention and without diminishing its attendant advantages. It is, therefore, intended that such changes and modifications be covered by the following claims.

I claim:

1. An aerial lift comprising:

a substantially horizontal supporting means;

a pivotable boom having an extensible load end and a pivot end;

means for mounting said boom to said supporting means so that said boom pivot end is substantially horizontally movable but vertically fixed;

a support arm having one end pivotally mounted to said support means and a second end pivotally mounted to said boom;

means for raising and lowering said boom so that as said boom load end is elevated, its boom pivot end moves substantially horizontally toward said support arm; and means for automatically extending said extensible load end as said load end is elevated to maintain said load end in a substantially vertical plane during elevation of said boom load end.

2. An aerial lift comprising:

a substantially horizontal supporting means;

a pivotable boom having a load end and a pivot end;

means for mounting said boom to said supporting means so that said boom pivot end is substantially horizontally movable but vertically fixed;

a support arm having one end pivotally mounted to said support means and a second end pivotally mounted to said boom; and means for raising and lowering said boom so that as said boom load end is elevated, its boom pivot end moves substantially horizontally toward said support arm, said raising and lowering means comprising a pivot cylinder having one end pivotally mounted to said supporting means at a point coaxial with the mounting of said support arm on said support means, and the other end pivotally mounted to said boom at a point between the boom load end and the point at which said support arm is mounted to said boom, said boom having an extensible portion adjacent said load end, said support arm having an extension which extends beyond said boom, and a telescoping cylinder pivotally reaching from said support arm extension to said extensible portion of said boom, so that as said pivot cylinder raises and lowers said boom, said telescoping cylinder automatically telescopes said extensible portion of said boom.

3. The aerial lift of claim 2 wherein said telescoping cylinder is extensible.

4. The aerial lift of claim 2 wherein said means for mounting said boom to said table comprises a beam which is slidably mounted to said table, said boom pivot end being pivotally mounted to said beam so that said beam reciprocates with respect to said table as said boom pivots upwardly and downwardly.

5. The aerial lift of claim 4 wherein said table further comprises a channel which is rotatable but otherwise stationary with respect to the remainder of said table, said beam being slidably mounted within said channel and said support arm and pivot cylinder being pivotally mounted to said channel so that the movable portions of said aerial lift and rotatable with respect to said table.

6. The aerial lift of claim 5, further comprising means for rotating said channel with respect to the remainder of said table.

7. An aerial lift comprising:

a mounting table;

a channel which is rotatably mounted to said table;

a pivotable boom having a pivot end, a load end and an extensible portion adjacent said load end;

a beam which is slidably mounted in said channel, said boom pivot end being pivotally mounted to said beam;

a support arm which is pivotally mounted to said channel and pivotally mounted to said boom, said support arm having an extension which extends beyond said boom;

a pivot cylinder for raising and lowering said boom, one end of said pivot cylinder pivotally mounted to said channel at a point coaxial with the point at which said support arm is mounted to said channel, and the other end of said pivot cylinder pivotally mounted to said boom between said boom load end and the point at which said support arm is mounted to said boom;

said boom is additionally provided with an extensible load end, and means for automatically extending said extensible load end as said load end is elevated to maintain said load end in a substantially vertical plane during elevation of said boom load end.

8. An aerial lift comprising:

a base;

a vertically adjustable, substantially horizontal mounting table having a horizontally extending channel therein;

means for raising and lowering said table above said base;

a pivotable boom having a load end, an extensible portion adjacent said load end, and a pivot end, a beam which is slidably mounted in said channel, said boom pivot end being pivotally mounted to said beam;

a support arm which is pivotally mounted to said channel and pivotally mounted to said boom, said support arm having an extension which extends beyond said boom;

a pivot cylinder for raising and lowering said boom, one end of said pivot cylinder pivotally mounted to said channel at a point coaxial with the point at which said support arm is mounted to said channel and the other end of said pivot cylinder pivotally mounted to said boom between said boom load end and the point at which said support arm is mounted to said boom;

a telescoping cylinder for extending and retracting said extensible portion of said boom, said telescoping cylinder reaching from said support arm extension to said extensible portion of said boom.

9. An aerial lift comprising;

a base;

a vertically adjustable, substantially horizontal mounting table;

a scissors-type elevator system for raising and lowering said table above said base, a pivotable boom having a load end, an extensible portion adjacent said load end, and a pivot end;

means for mounting said boom to said table so that said boom pivot end is horizontally movable but vertically fixed;

a support arm having one end pivotally mounted to said table, a second end pivotally mounted to said boom, and an extension which extends beyond said boom, rigid cylinder means pivotally reaching from said support arm extension to said extensible portion of said boom for automatically extending and retracting said extensible portion of said boom; and a pivot cylinder for raising and lowering said boom, one end of said pivot cylinder pivotally mounted to said mounting table at a point coaxial with the point at which said support arm is mounted to said mounting table and the other end pivotally mounted to said boom at a point between said boom load end and the point at which said support arm is mounted to said boom so that as the vertical portion of said boom load end is varied, the horizontal position of said boom pivot end is automatically adjusted.

10. The aerial lift of claim 9, wherein said means for mounting said boom to said table comprises:

a substantially horizontal beam, to which said boom pivot end is pivotally mounted;

a channel in which said beam is slidably mounted so that said beam reciprocates with respect to said channel as said boom pivots upwardly and downwardly, said channel being rotatable but otherwise stationary with respect to the remainder of said mounting table, and wherein said support arm and pivot cylinder are pivotally mounted to said channel so that said boom, beam, channel, support arm, pivot cylinder and telescoping cylinder are rotatable as a unit with respect to said mounting table.

* * * * *